US006658735B2

(12) United States Patent
Ito

(10) Patent No.: US 6,658,735 B2
(45) Date of Patent: Dec. 9, 2003

(54) CRIMPING TERMINAL FOR CONNECTION BETWEEN ELECTRIC CABLES

(75) Inventor: Akira Ito, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/244,572

(22) Filed: Sep. 16, 2002

(65) Prior Publication Data

US 2003/0015341 A1 Jan. 23, 2003

Related U.S. Application Data

(62) Division of application No. 09/829,591, filed on Apr. 10, 2001, now abandoned.

(30) Foreign Application Priority Data

Jun. 13, 2000 (JP) ..... 2000-177023

(51) Int. Cl.[7] ..... H01R 43/00; H01R 43/04; H01R 4/00

(52) U.S. Cl. ..... 29/868; 29/869; 29/871; 29/873; 174/84 C

(58) Field of Search ..... 174/74 R, 74 A, 174/77 R, 80, 84 R, 84 C, 88 R; 29/868, 869, 871, 873

(56) References Cited

U.S. PATENT DOCUMENTS

| | | | | |
|---|---|---|---|---|
| 3,143,595 A | | 8/1964 | Martin | |
| 3,417,195 A | | 12/1968 | Shlesinger, Jr. | |
| 3,708,611 A | * | 1/1973 | Dinger | 174/84 C |
| 4,208,788 A | * | 6/1980 | Siden | 29/862 |
| 4,959,508 A | * | 9/1990 | McGrane | 174/84 C |
| 4,993,149 A | | 2/1991 | Zilligen et al. | |
| RE33,591 E | * | 5/1991 | Feeny et al. | 156/85 |
| 5,221,815 A | | 6/1993 | Bostock et al. | |
| 5,278,354 A | | 1/1994 | Lhomme | |
| 5,393,932 A | * | 2/1995 | Young et al. | 174/84 R |
| 5,422,438 A | | 6/1995 | Lamome | |
| 5,514,835 A | | 5/1996 | Wing | |
| 5,672,846 A | | 9/1997 | Debbaut | |
| 5,749,756 A | | 5/1998 | Vockroth et al. | |
| 5,875,547 A | * | 3/1999 | Larsson et al. | 29/869 |

FOREIGN PATENT DOCUMENTS

JP 10-322870 12/1998

* cited by examiner

*Primary Examiner*—William H. Mayo, III
(74) *Attorney, Agent, or Firm*—Gerald F. Hespos; Anthony H. Casella

(57) ABSTRACT

The present invention discloses a crimping terminal which can interrupt immersion of water in an electric cable and maintain a waterproof function of a mating member, thereby enhancing reliability of connection between electric cables. A crimping terminal 10 is provided on each of cylindrical opposite ends with a crimping portion 11 having an insertion hole 12 with a bottom, which receives core wires e in an electric cable C. A solid body is formed between the crimping portions 11 in a liquid-tight manner. Preferably, the crimping terminal 10 is used together with a thermal-shrinkable tube 15 having an adhesive on its inner surface so that the thermal-shrinkable tube 15 comes into close contact with outer surfaces of the crimping portions and electric cables C.

2 Claims, 3 Drawing Sheets

CRIMPING TERMINAL FOR CONNECTION BETWEEN ELECTRIC CABLES

This application is a divisional of U.S. patent application Ser. No. 09/829,591 filed Apr. 10, 2001, now abandoned.

BACKGROUND OF THE INVENTION

1. Field of the Invention

This invention relates to a crimping terminal for connection between electric cables, and more particularly, the invention relates to a crimping terminal that can prevent moisture from coming into clearances between core wires in the electric cables.

2. Description of the Related Art

Prior art electric cables that extend from electric devices easily can be coupled to or disconnected from each other by attaching a connector to each of the electric cables and coupling and disconnecting the connectors. Some prior art connectors are constructed to prevent the intrusion of water. For example, as shown in FIG. 5, waterproof connectors 1 and 2 are attached to the electric cables C. The FIG. 5 assembly also includes a non-waterproof connector 3 that is attached to an electric cable C Additionally, a so-called round terminal 4 or the like is attached to an electric cable C to perform direct screw connection. These connections involve different handlings due to differently designed wiring paths and costs for the respective electric cables C.

The electric cable C conventionally is constructed by twisting a plurality of soft copper wires "e" and covering the wires with a vinyl chloride sheath, as shown in FIG. 6. The sheath functions as an electrical insulation. However, water readily enters an end of the electric cable and flows downstream due to capillary phenomenon. For example, as shown in FIG. 7, an insulation barrel I is crimped on an outer surface of the electric cable C and a wire barrel W is crimped on core wires "e" the sheath of which is stripped at an end of the electric cable C. Consequently, water enters an end of the electric cable C and reaches the waterproof type connectors 1 and 2. In the worst case, this may cause an electrical short-circuit. The non-waterproof connector 3 has a similar terminal (not shown) that merely is crimped on the electric cable C. Thus, the same water-related accidents will occur in the electric cable.

Accordingly, an object of the present invention is to obtain a waterproof function of a mating member to which an electric cable is connected and to enhance reliability of connection between the electric cables by preventing water from entering the electric cables.

SUMMARY OF THE INVENTION

The subject invention is directed to a crimping terminal for connection between electric cables. The crimping terminal includes at least two crimping portions each of which is crimped on an end of an electric cable. The electric cables are connected to each other by crimping the crimping portions, thereby extending the electrically conductive path. The crimping terminal is characterized by a liquid-tight solid portion between the crimping portions.

The solid liquid-tight body between the crimping portions of the crimping terminal is different from a conventional tubular terminal for connection. Water cannot enter the crimping terminal and the body made of a conductive material can electrically connect the electric cables. Consequently, the crimping terminal can interrupt water, which enters an electric cable at an up stream-side and flows in the cable. The crimping terminal also can prevent water from further flowing in an electric cable at a down stream-side.

The invention also is directed to a crimping terminal as described above, but further comprising a tubular member made of a thermal-shrinkable material. The tubular member is adapted to cover the outer surfaces of the crimping portions in a liquid-tight manner and extends to cover the ends of the electric cables adjacent the crimping portions. A material is applied on an inner surface of the tubular member so that the inner surface comes into contact with outer surfaces of the crimping terminal and electric cables in a liquid-tight manner In this embodiment of the invention, it is possible to bring the tubular member into close contact with the outer surfaces of the crimping portions and ends of the electric cables by heating the tubular member with a dryer or the like. Accordingly, it is possible to prevent the water, which is interrupted in the electric cable, from coming out onto the outer surfaces of crimping portions and entering an electric cable at a down stream side from an electric cable at an up stream side

BRIEF DESCRIPTION OF THE DRAWINGS

The foregoing and other features of the present invention will become apparent to one skilled in the art to which the present invention relates upon consideration of the invention with reference to the accompanying drawings, wherein.

DEATAILED DESCRIPTION OF THE PREFERRED EMBODIMENTS

Figure 1:
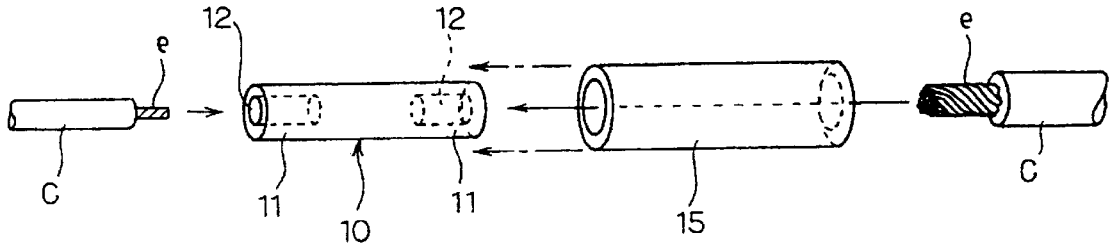
FIG. 1 is a perspective view of a first embodiment of a crimping terminal for connection between electric cables in accordance with the present invention, illustrating a general construction of the embodiment.

A crimping terminal in accordance with the subject invention is identified by the numeral 10 in FIG. 1. The crimping terminal 10 is made of the same material as that of a conventional crimping terminal and is formed into a cylindrical configuration. Crimping portions 11 are defined at opposite ends of the crimping terminal 10, and insertion holes 12 with bottoms are formed coaxially in the respective crimping portions 11. The insertion holes 12 are dimensioned to receive each end of core wires e in an electric cable C. The crimping terminal 10 can electrically connect ends of the electric cables C by stripping an end of a sheath of the electric cable C to expose ends of the core wires e in the cable C, inserting the exposed ends of the core wires e into the insertion hole 12, and clamping and deforming peripheries of the crimping portions 11 by means of a crimping tool (not shown). The crimping terminal 10 may be produced by means of a machining process or a molding process in consideration of cost and in accordance with quantity.

Figure 2:
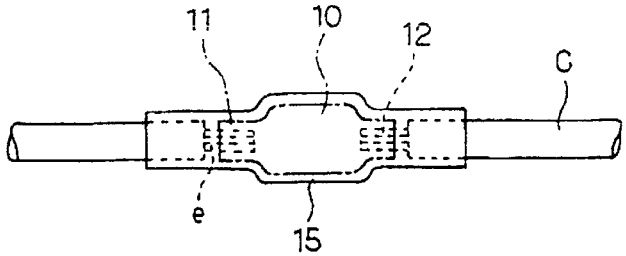
FIG. 2 is a plan view of the first embodiment in use.

The electric cables C are inserted into a thermal-shrinkable tube 15 having an adhesive on its inner surface before or after crimping. The thermal-shrinkable tube 15 can electrically insulate the crimping terminal 10. More particularly, the crimping terminal 10, which clamps an end of each electric cable C in each crimping portion 11, is disposed in the thermal-shrinkable tube 15 and the tube is heated by a dryer or the like. Then, as shown in FIG. 2, the thermal-shrinkable tube 15 comes into close contact with outer surfaces of the crimping terminal 10 and the ends of the electric cables C.

Figure 3:
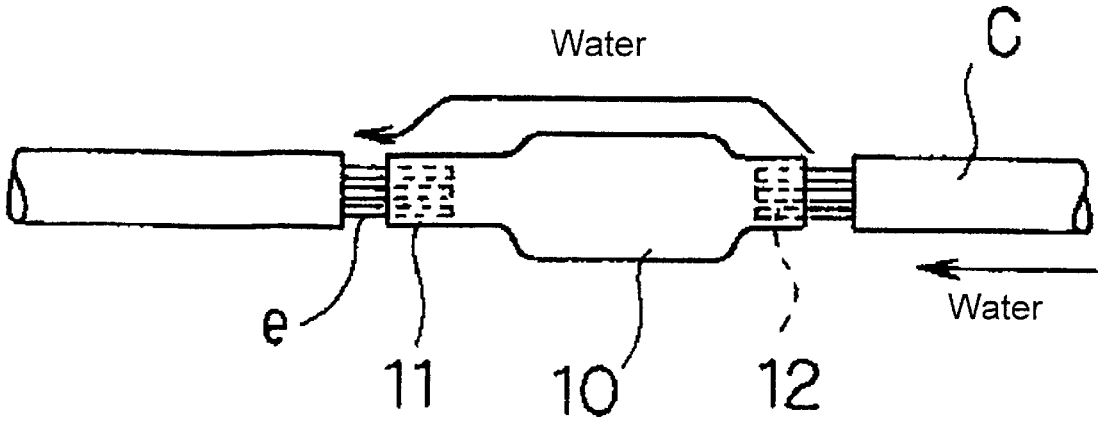
FIG. 3 is an explanatory view of the first embodiment, illustrating effects thereof.

Accordingly, the crimping terminal 10 can electrically connect and extend the electric cables C coupled to the crimping portions 11. The crimping terminal 10 also can interrupt a water flow passage to be defined in the core wires e in the electric cables C by occluding a space between the insertion holes 12 in the crimping portions 11 and by preventing the water which enters an electric cable C at an up stream side from flowing into an electric cable C at a down stream side. The crimping terminal 10 can further prevent the interrupted water from coming out onto an outer surface of the crimping terminal 10 from the electric cable C at the up stream side and again entering the electric cable at the down stream side, as shown in FIG. 3.

In this embodiment, the crimping terminal 10 can connect and extend the electric cables C, and prevent the water in the core wires e in the electric cable C at the up stream side from flowing out of the electric cable C at the up stream side to the electric cable C at the down stream side by bringing the thermal-shrinkable tube 15 into close contact with the outer surfaces of the crimping terminal 10 and ends of the electric cables C in a liquid-tight manner. Accordingly, it is possible to couple an electric cable C to another connector while maintaining a waterproof function of a waterproof connector, for example, by crimping and interconnecting electric cables C at an up stream side from the waterproof connector by means of the crimping terminal 10 and covering the connected portions with the thermal-shrinkable tube 15.

In another embodiment of a waterproof structure, a vinyl tape may be wound around an outer surface of the crimping terminal and outer surfaces of ends of the electric cables C to obtain a liquid-tight function without using the thermal-shrinkable tube 15. However, a clearance may be formed between laminated layers of the tape at its end edges. Accordingly, it will be better to use a thermal-shrinkable tube with an adhesive in the first embodiment described above.

The first embodiment described above utilizes the crimping terminal 10 along with the thermal-shrinkable tube 15. However, when the electric cables C are connected at a place where no water enters, only the crimping terminal 10 may be used. It is possible to prevent water from flowing downstream by interrupting water from an up stream side and causing the water to evaporate or go down.

Figure 4:
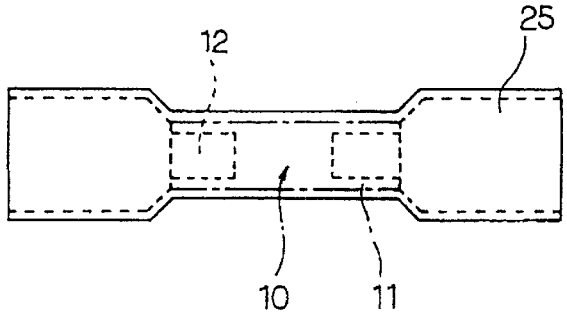
FIG. 4 is a plan view of a second embodiment of a crimping terminal for connection between electric cables in accordance with the present invention, illustrating a general construction of the second embodiment.
Figure 5:
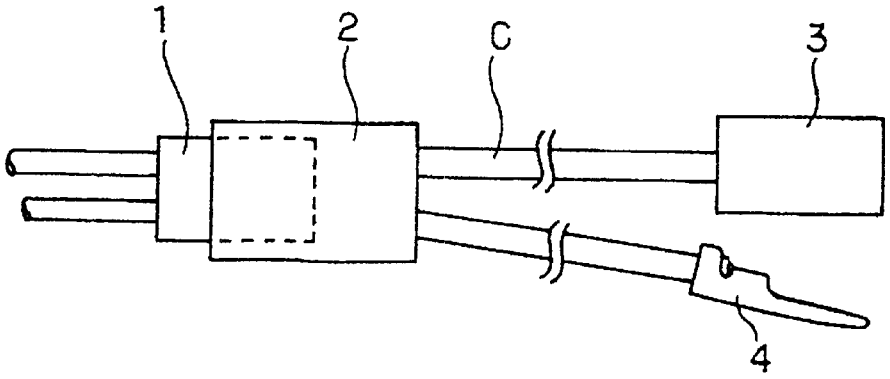
FIG. 5 PRIOR ART
FIG. 5 is a plan view of conventional connections between electric cables.
Figure 6:
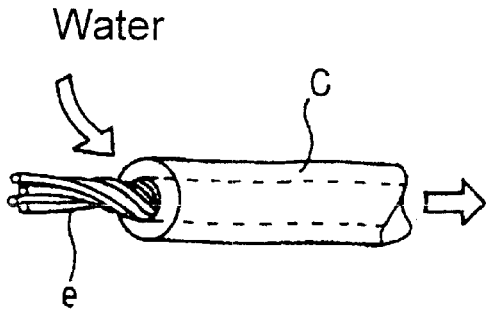
FIG. 6 PRIOR ART
FIG. 6 is a perspective view of an electric cable, illustrating a structure thereof.
Figure 7:
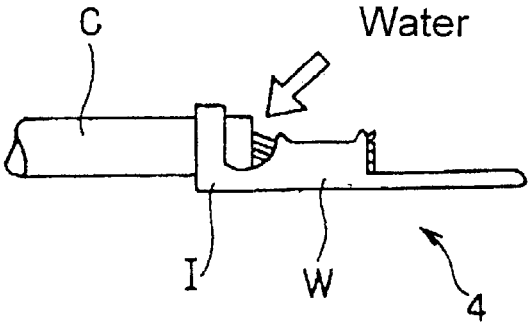
FIG. 7 PRIOR ART
FIG. 7 is a side elevation view of a conventional terminal, illustrating a problem therein.

FIG. 4 shows a second embodiment of a crimping terminal for connection between electric cables in accordance with the present invention. Since the second embodiment substantially has the same construction as that of the first embodiment, the same signs are given to the same elements in the second embodiment and only characterized portions or elements will be explained below.

In FIG. 4, a thermal-shrinkable tube 25 extends over the crimping portions 11 at opposite ends of the crimping terminal 10 and is attached to the terminal 10 before hand. The thermal-shrinkable tube 25 is heated at only portions corresponding to outer surfaces of the crimping terminal 10 and is positioned on the terminal so that an adhesive on an inner surface of the tube comes into close contact with and joins the outer surface of the terminal in a liquid-tight manner so as not to dropout from the terminal.

Therefore, the crimping terminal 10 can receive the core wires e of the electric cable C in the insertion hole 12 with the thermal-shrinkable tube 25 covering an end of the electric cable C. After clamping and deforming the thermal-shrinkable tube 25 and crimping portions 11 by means of a clamping tool, the thermal-shrinkable tube 25 is brought into close contact with the outer surfaces of the ends of the electric cable C as well as the outer surface of the crimping terminal 10.

Thus, the second embodiment can eliminate the step of mounting the thermal-shrinkable tube 15 onto the crimping terminal 10 before and after crimping, thereby enhancing work efficiency in addition to operational effects of the first embodiment.

Although the crimping terminal 10 has the crimping portion 11 on each end in the above embodiments, this invention is not so limited. For example, the crimping terminal may have a three-way, or four or more-way type of crimping portions 11.

According to the present invention, it is possible to crimp and connect the electric cables while interrupting a water flow passage in the electric cables and to prevent the interrupted water from coming out onto outer surfaces of the crimping portions by causing the thermal-shrinkable tube to be closely shrunk on the outer surfaces of the crimping portions and the electric cables. Consequently, it is possible to prevent the water, which enters the electric cable, from flowing out of an electric cable at an up stream side to an electric cable at a down stream side and to arrange electric cables in facilities while maintaining a waterproof function of a mating member, thereby enhancing reliability of connection of electric cables.

From the above description of the invention, a person skilled in the art will perceive improvements, changes and modifications. Such improvements, changes and modifications within the skill of the art are intended to be covered by the appended claims.

The entire disclosure of Japanese Patent Application No. HEI 12-177023 (2000) filed on Jun. 13, 2000 including specification, claims, drawings and summary is incorporated herein by reference in its entirety.

What is claimed is:

1. A method for connecting first and second electric cables, said method comprising:

providing first and second cables, each said cable having a conductive core and an insulation layer surrounding the core;

preparing an end of each said cable by removing the insulation and forming an exposed section of the core adjacent the end of the respective cable;

providing an elongate rod-shaped terminal unitarily formed from a conductive material and having opposite first and second ends, a solid connecting portion disposed at a location between said first and second ends and first and second insertion holes being formed centrally in said first and second ends, said insertion holes being dimensioned to slidably receive the exposed sections of the respective cores of the respective first and second cables;

mounting a tubular heat-shrinkable sleeve over the elongate rod-shaped terminal, said tubular heat-shrinkable sleeve having a first end projecting axially beyond the first end of the rod-shaped terminal and a second end projecting axially beyond the second end of the elongate rod-shaped terminal;

performing a first heat-shrinking step on portions of said heat-shrinkable sleeve aligned with said elongate rod-shaped terminal such that central portions of said tubular heat-shrinkable sleeve between said first and second ends thereof tightly engage outer surface regions of said elongate rod-shaped terminal at substantially all locations between said first and second ends of said terminal;

inserting the exposed conductive cores of the first and second cables through the respective first and second ends of the heat-shrinkable sleeve and into the respective first and second insertion holes of the terminal;

crimping inwardly portions of said heat-shrinkable sleeve that were shrunk by the first heat-shrinking step and portions of said terminal aligned with said first and second insertion holes, such that crimped portions of said terminal electrically contact the exposed conductive cores of the first and second cables;

performing a second heat-shrinking step on portions of said sleeve adjacent said first and second ends such that said sleeve shrinks into secure engagement with portions of said first and second cables adjacent said first and second ends of said terminal.

2. The method of claim 1, wherein the heat-shrinkable sleeve has an adhesive coating on an inner circumferential surface thereof, the step of heating the heat-shrinkable sleeve comprising heating the heat-shrinkable sleeve sufficiently to activate the adhesive for secure adhesive connection between said sleeve and both said terminal and said cables.

* * * * *